US007784243B2

(12) United States Patent
Zahner, III

(10) Patent No.: US 7,784,243 B2
(45) **Date of Patent: *Aug. 31, 2010**

(54) I-BEAM WITH CURVED FLANGES

(75) Inventor: L. William Zahner, III, Kansas City, MO (US)

(73) Assignee: A. Zahner Company, Kansas City, MO (US)

( * ) Notice: Subject to any disclaimer, the term of this patent is extended or adjusted under 35 U.S.C. 154(b) by 1 day.

This patent is subject to a terminal disclaimer.

(21) Appl. No.: 12/110,852

(22) Filed: Apr. 28, 2008

(65) Prior Publication Data

US 2008/0196356 A1 Aug. 21, 2008

Related U.S. Application Data

(62) Division of application No. 11/032,958, filed on Jan. 11, 2005, now Pat. No. 7,434,366.

(51) Int. Cl.
*E04C 2/38* (2006.01)

(52) U.S. Cl. ..... 52/846; 52/838; 52/848

(58) Field of Classification Search ..... 52/729.1–729.3, 52/690, 696, 731.1, 737.1, 393, 837, 838, 52/846, 856

See application file for complete search history.

(56) References Cited

U.S. PATENT DOCUMENTS

RE21,921 E * 10/1941 Greulich ..... 52/838
3,046,852 A * 7/1962 Graham ..... 52/581
3,283,464 A * 11/1966 Litzka ..... 52/636
3,300,839 A * 1/1967 Lichti ..... 29/897.35
3,517,474 A * 6/1970 Lanternier ..... 52/842
3,555,762 A * 1/1971 Costanzo, Jr. ..... 52/588.1
3,698,224 A 10/1972 Saytes
5,501,053 A * 3/1996 Goleby ..... 52/842
5,553,437 A 9/1996 Navon
5,722,626 A * 3/1998 Menchetti et al. ..... 248/346.01
6,131,362 A 10/2000 Buecker

* cited by examiner

*Primary Examiner*—Brian E Glessner
*Assistant Examiner*—James J Buckle, Jr.
(74) *Attorney, Agent, or Firm*—Hovey Williams LLP

(57) ABSTRACT

An I-beam (10) comprises a first D-shaped flange (20) and a second D-shaped flange (60) connected by a web (100). Each flange includes a planar segment (30,70) and a curved segment (40,80). A lip (50,90) depends from the planar segment (30,70) of each flange (20,60) and is adapted to be attached to the web (100). The curved segment (40,70) of each flange (20,60) includes an outer surface (42,82) and an outer surface (44,84). The outer surface (42,82) is serrated to grip a wall panel or other structure attached to the flange (20,80) and the inner surface includes ridges (46,86) to strengthen the flange (20,60).

4 Claims, 7 Drawing Sheets

I-BEAM WITH CURVED FLANGES

RELATED APPLICATION

The present application is a divisional patent application and claims priority benefit, with regard to all common subject matter, of earlier-filed U.S. non-provisional patent application titled "I-BEAM WITH CURVED FLANGES", Ser. No. 11/032,958, filed Jan. 11, 2005, issued into U.S. Pat. No. 7,434,366 Oct. 14, 2008. The identified earlier-filed application is hereby incorporated by reference in its entirety into the present application.

BACKGROUND

1. Field

The present invention relates to an I-beam adapted to support the panels of a curved surface of a building. More particularly, the present invention relates to an I-beam with a D-shaped flange that permits a planar wall panel to be attached to the flange at any point along a curved surface of the flange.

2. Related Art

Property owners place increasing emphasis on aesthetics when planning and designing buildings or other structures, and may depart substantially from the traditional building design consisting of a rectangular frame with planar surfaces. A modern building may have an arbitrarily curved frame with correspondingly curved surfaces, for example, or may have a rectangular frame with inner or outer surfaces that are arbitrarily curved along one or more directions.

Such structures with curved frames and/or surfaces present challenges in design and construction. Traditional building materials, for example, may not be adapted to accommodate a curved structure or curved surface. The walls of a traditional, rectangular building, for instance, are planar and the outer surfaces thereof may consist of an array of planar wall panels lying substantially within the plane of the wall. Such panels may be attached to the building using traditional I-beams with planar flanges, wherein each panel is parallel with, and secured to, the planar flanges of one or more I-beams. Unfortunately, it is very difficult or impossible to use traditional I-beams in a similar manner to support the panels of a curved surface because the panels may not be planar and/or may not be parallel with the flanges of the I-beams.

These problems may be partially alleviated by placing an intermediate structure between the I-beams and the wall panels, wherein the intermediate structure is adapted to support the wall panels at a particular angle by attaching to the wall panel and to the I-beam. Use of an intermediate structure has the disadvantage, however, of adding to the overall cost of the structure by requiring more time and/or materials to manufacture and more time to assemble and/or place the structure and the panels at the construction site.

Another disadvantage of using traditional I-beams to support the outer surface of a building is that such use may result in condensation that accumulates and drips, thus damaging the building over time. For example, fasteners used to secure wall panels to the I-beams, such as a nut and bolt combination, may extend through both the panel and the flange of the I-beam and protrude an inch or more beyond the flange and into the structure. Because such fasteners are in contact with the outer surface of the building, cooler external temperatures will cool the fasteners, causing moisture to condense and accumulate on the portion of the fasteners that extend inside the building. It will be appreciated that if such condensation drips on the inside of the building it may damage the building by soaking interior wall or ceiling panels, or by pooling on metal surfaces and causing rust or other corrosion. Many walls have several hundred such fasteners; therefore, moisture condensation may present a substantial problem.

Beams with tubular flanges, wherein each flange includes a curved outer surface, are known in the art. Unfortunately, such beams do not address the growing needs discussed above. Most, for example, lack the requisite structural integrity to support a structural element of substantial weight, particularly when the structural element is planar or otherwise makes minimal contact with the flange. Many of the beams also exhibit outer curved surfaces with varying radii of curvature, which may further compromise structural integrity and impede attachment of a structural element to the flange at particular angles.

Due to the above mentioned and other problems and disadvantages in the art, a need exists for an improved I-beam capable of attaching to and supporting planar wall panels at any of various angles, and adapted to prevent or contain condensation on the fasteners that secure the wall panels to the beam.

SUMMARY OF THE INVENTION

The present invention solves the above-described problems and provides a distinct advance in the art by providing an I-beam with D-shaped flanges. The I-beam is adapted to attach to the frame of a building and provide a point of attachment to support structural elements, such as wall panels, at various angles. In particular, the I-beam is adapted to support a wall panel that forms part of a curved surface of a building by allowing the panel to attach to the flanges of the I-beam at various angles.

In a preferred embodiment, the I-beam comprises a first flange including a peripheral wall with a planar segment and a curved segment, and a lip; a second flange including a peripheral wall with a planar segment and a curved segment, and a lip; and an interconnecting web with a first longitudinal edge and a second longitudinal edge.

The flanges strengthen the I-beam and provide points of attachment for wall panels or other structural elements. The curved segment of each flange presents an infinite number of points of attachment as the point of contact between a planar wall panel and the flange is a single line. The lip extends perpendicularly approximately one inch from an outer surface of the planar segment of the peripheral wall. The lip runs longitudinally along the length of the flange and allows the flange to be secured to the web by providing a point of attachment to the web. The flange may be attached to the web in any of a variety of ways, such as welding, bolting, or riveting.

The curved segment of the first flange has an outer surface and an inner surface. The outer surface is the point of contact for the wall panel or other structural element attached to the I-beam and is preferably serrated to grip the panel. The inner surface of the curved segment may include ridges that further strengthen the flange. In the preferred embodiment, the inner surface includes two ridges that are substantially triangle-shaped and extend approximately one-eighth of an inch from the inner surface.

It will be appreciated that the peripheral wall of the flange may prevent the damage resulting from excess condensation dripping from fasteners by enclosing the fasteners and thus preventing the accumulation of condensation or channeling the flow of excess condensation.

The second flange is similar in structure and function to the first flange, and is located on the I-beam opposite the first flange so that the flanges are substantially parallel along a longitudinal direction. The lips of the flanges point toward a center of the I-beam and the curved segments protrude away from the center of the I-beam.

The web connects the first flange to the second flange and must be strong enough to support a wall panel or other structural element. The web is preferably planar and includes a first longitudinal edge and a second longitudinal edge. The first edge of the web abuts against the planar segment of the first flange so that the web overlaps, and is in contact with, the lip of the flange. The lip may then be attached to the web with a rivet, weld or other fastener or method as explained above. Similarly, the second edge abuts against the planar segment of the second flange so that the web overlaps and attaches to the lip. The web need not be planar but may include edges that are curved along a longitudinal axis, and the flanges may be removably attachable to the web to facilitate the manufacture of I-beams of different sizes and shapes.

These and other important features of the present invention are more fully described in the section titled DETAILED DESCRIPTION OF PREFERRED EMBODIMENTS, below.

BRIEF DESCRIPTION OF THE DRAWINGS

A preferred embodiment of the present invention is described in detail below with reference to the attached drawing figures, wherein.

DETAILED DESCRIPTION OF PREFERRED EMBODIMENTS

Figure 1:
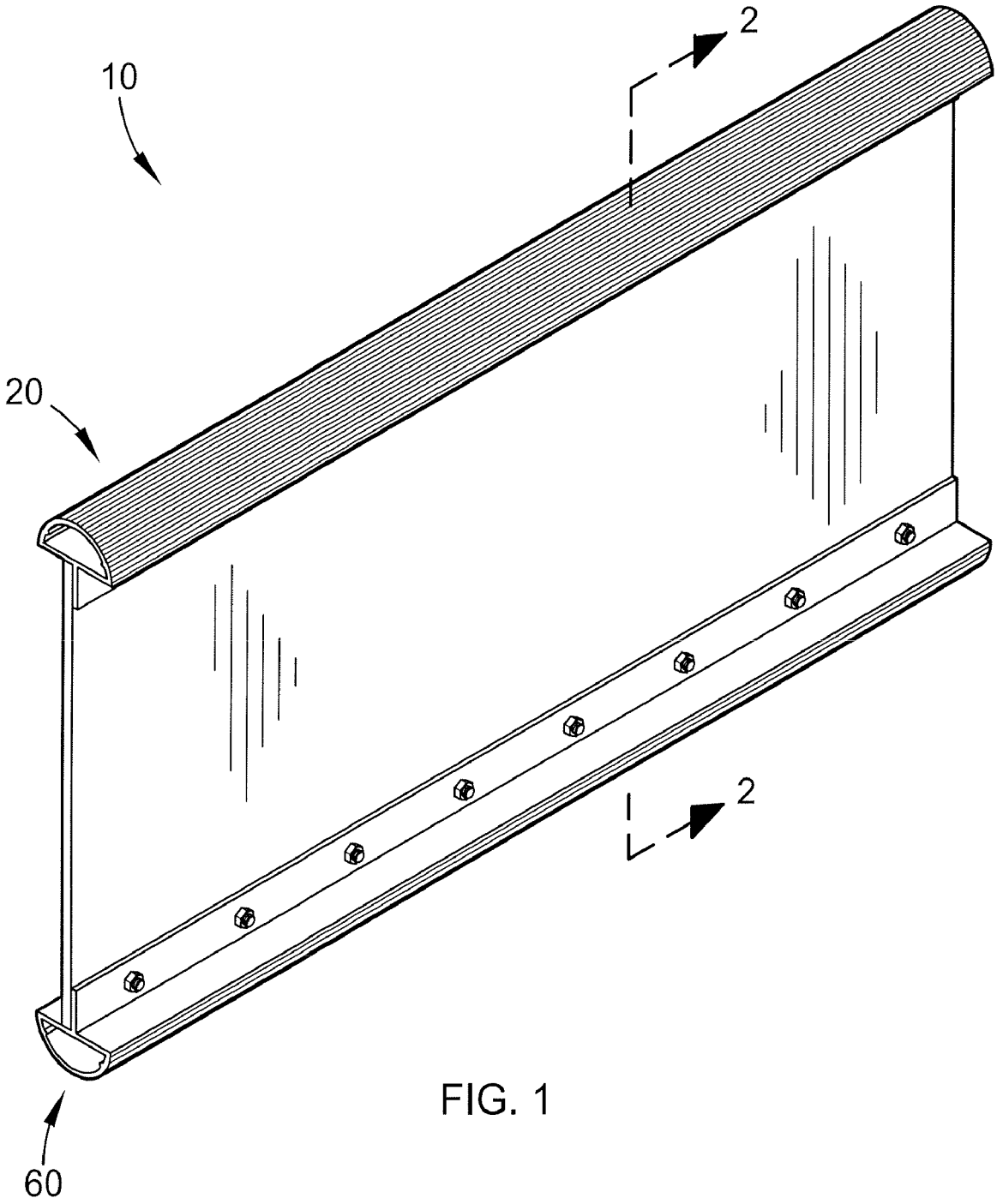
FIG. 1 is a perspective view of an I-beam with D-shaped flanges constructed in accordance with a preferred embodiment of the present invention.

Referring to FIG. 1, an I-beam 10 with curved flanges 20,60 is shown constructed in accordance with a preferred embodiment of the present invention. In this embodiment, the flanges 20,60 are preferably D-shaped, but they may be of other curved shapes as discussed below. The I-beam 10 is adapted to attach to the frame of a building and provide a point of attachment to support structural elements, such as wall panels, at varying angles. In particular, the I-beam 10 is adapted to support a wall panel that forms part of a curved surface of a building by allowing the panel to attach to the flanges 20,60 of the I-beam 10 at various angles.

Figure 2:
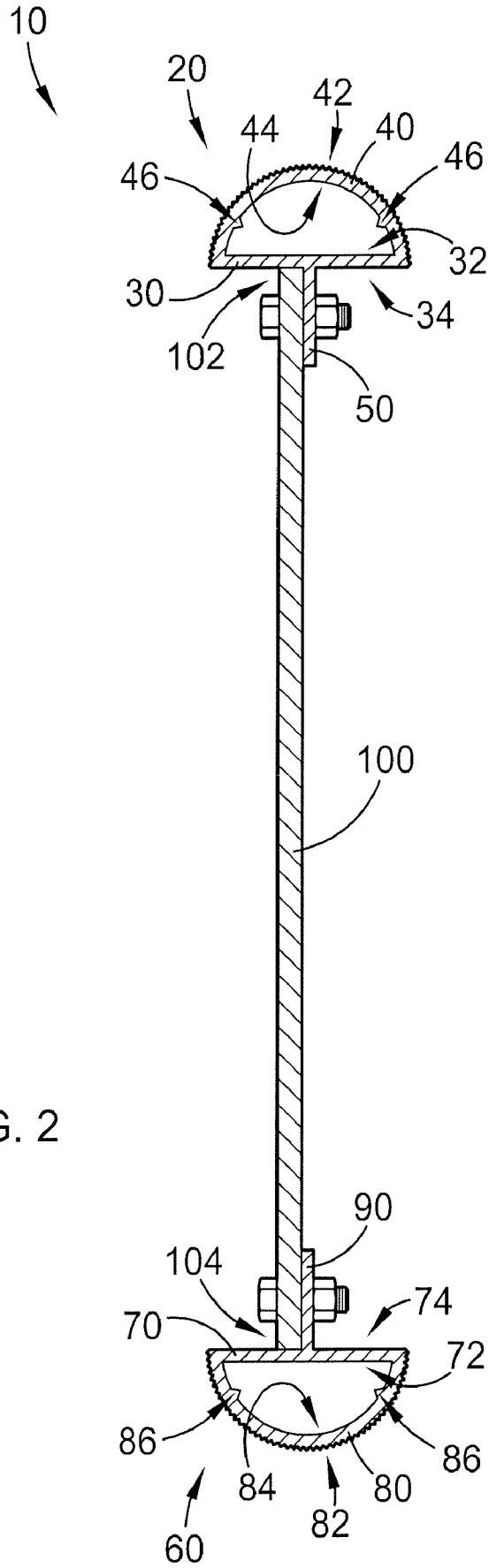
FIG. 2 is a vertical cross-sectional view of the I-beam of FIG. 1.
Figure 3:
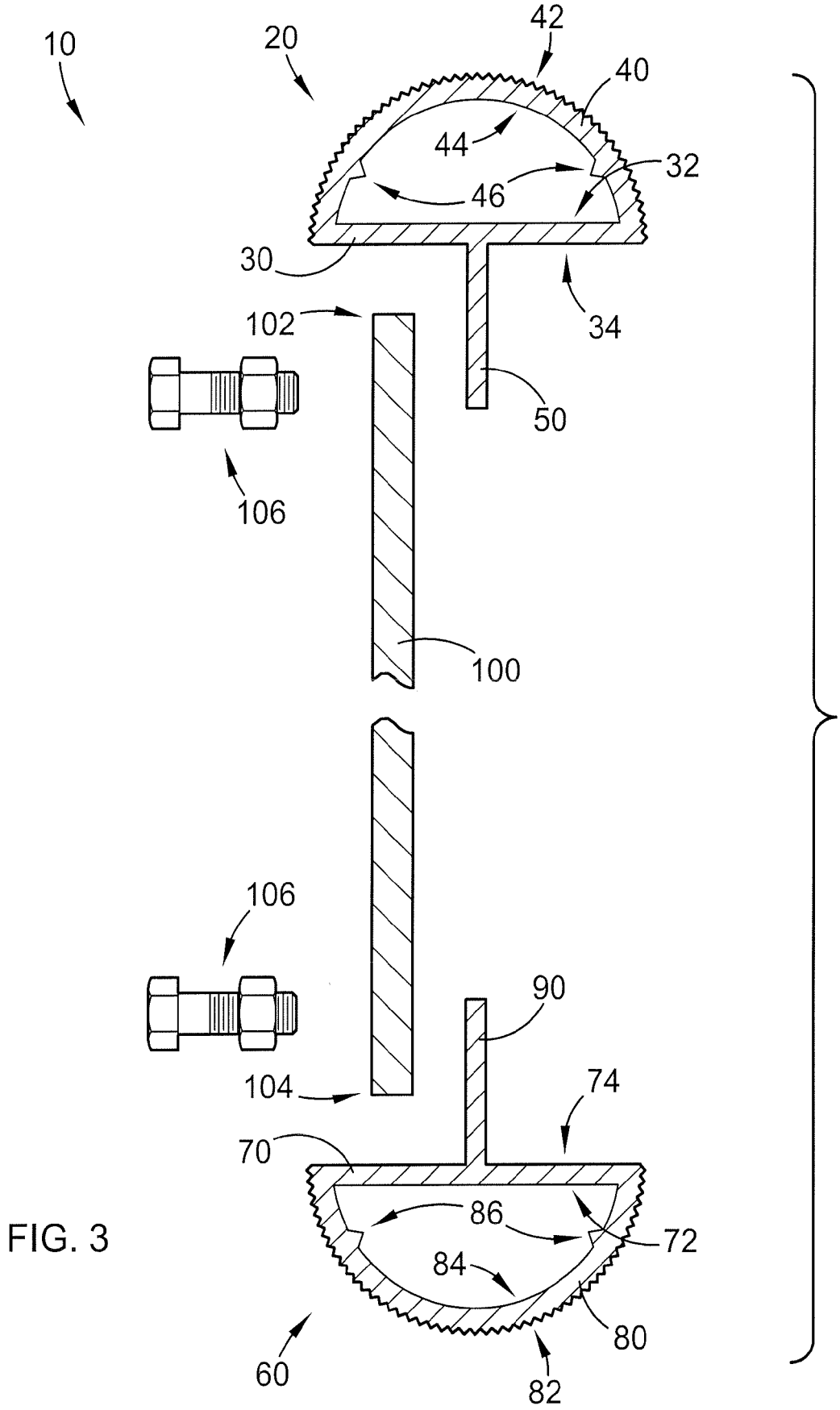
FIG. 3 is an exploded vertical cross-sectional view of the I-beam of FIG. 1.

FIGS. 2 and 3 present vertical cross-sectional views of the I-beam 10. The I-beam 10 comprises a first flange 20 including a peripheral wall with a planar segment 30 and a curved segment 40, and a lip 50; a second flange 60 including a peripheral wall with a planar segment 70 and a curved segment 80, and a lip 90; and an interconnecting web 100 with a first longitudinal edge 102 and a second longitudinal edge 104.

Figure 4:
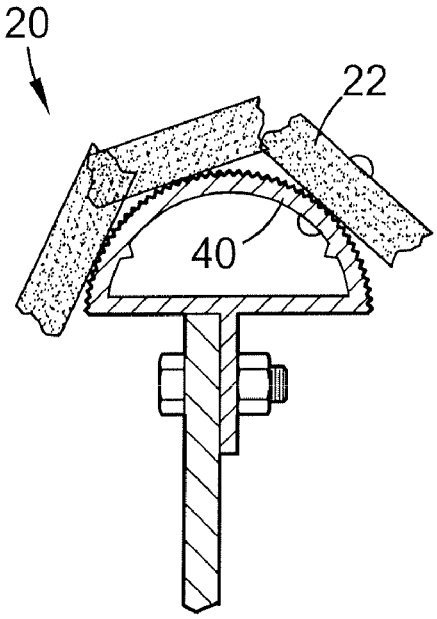
FIG. 4 is a vertical cross-sectional view of a flange of the I-beam of FIG. 1 illustrating how a planar wall panel may attach to the flange.

The purpose of the flanges 20,60 is to strengthen the I-beam 10 and to provide points of attachment for wall panels or other structural elements. The flanges 20,60 strengthen the I-beam 10 by resisting bending along a longitudinal direction. The D-shaped flange provides strength beyond that of traditional, planar I-beam flanges in that the rigidity of the planar segments 30,70 is enhanced by the rigidity of the curved segments 40,80. The flanges 20,60 also provide points of attachment, wherein the wall panels may be attached to any point on the peripheral wall of the flange with, for example, a nut and bolt combination or a rivet. It will be appreciated that the curved segments 40,80 of the flanges 20,60 present an infinite number of points of attachment. The point of contact between a planar wall panel and the flange 20, for example, would be a single line. This is illustrated in FIG. 4, where a planar wall panel 22 is shown secured to the curved segment 40 of the flange 20. Alternate positions of the panel 22 are depicted with dashed lines.

The planar segment 30 of the first flange 20 includes an inner surface 32 and an outer surface 34. The lip 50 extends perpendicularly approximately one inch from the outer surface 34. The lip 50 is preferably integrally attached to the planar segment 30 of the peripheral wall and runs longitudinally along the length of the flange 20, as illustrated in FIG. 1. The lip 50 allows the flange 20 to be secured to the web 100 by providing a point of attachment to the web 100. The lip 50 attaches to the web 100 by, for example, riveting or welding the lip 50 to the web 100.

The lip 50 has been depicted as extending substantially from a center of the planar segment 30 of the flange 20, but may extend from any point along the segment 30. It may be desirable, for example, to locate the lip 50 off-center so that the lip 50 and the first longitudinal edge 102 together are centered beneath the flange 20. It may also be desirable to include two parallel lips placed on either side of the web 100 to provide a more secure attachment to the web 100.

Figure 5:
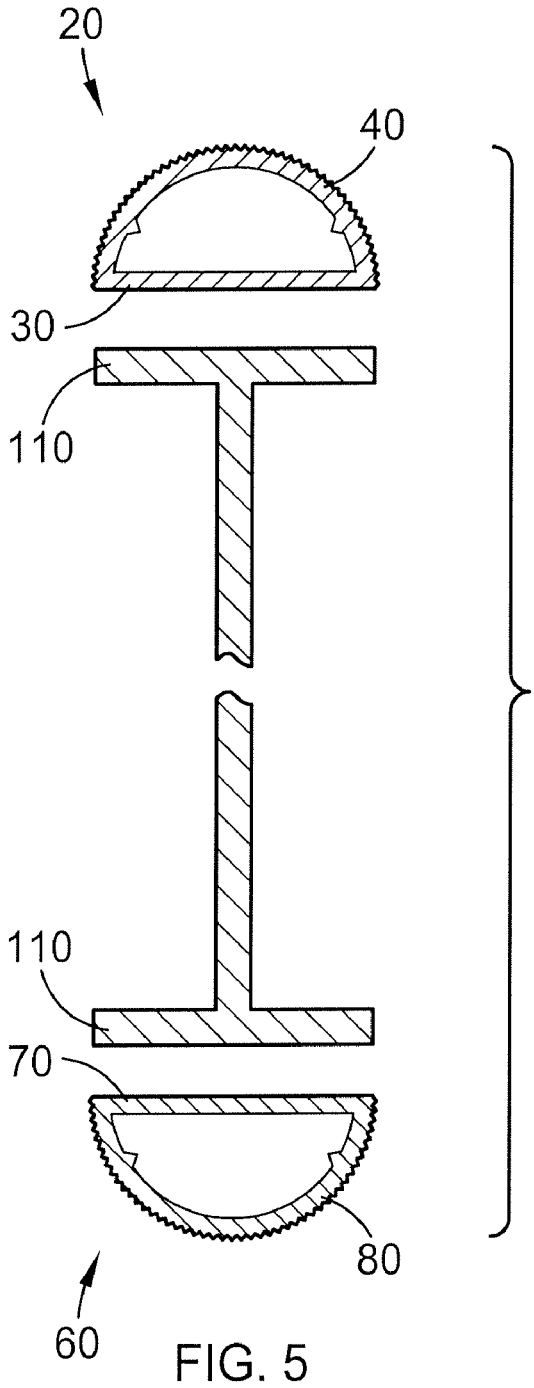
FIG. 5 is a vertical cross-sectional view of the I-beam of FIG. 1 illustrating an alternate method of attaching the flanges to the beam.

It will be appreciated that the flange 20 may be attached to the web 100 in any of a variety of ways. It may be desirable, for example, to use a nut and bolt combination 106 or other removable fastener to attach the lip 50 to the web 100. Removably attaching the flange 20 to the web 100 may facilitate the manufacture and/or implementation of the I-beam 10 by allowing the flanges 20,60 and the web 100 to be manufactured independently and assembled after manufacture, either before or after sale. This may be particularly helpful where the web 100 is curved and/or of varying height, as described below and illustrated in FIGS. 7-10. Another method of attaching the flange 20 to the web 50 includes using a traditional I-beam with planar flanges 110 as illustrated in FIG. 5. In such a design, the planar flanges 110 may fixedly or removably attach to the planar segments 30,70 of the flanges 20,60 by riveting, welding, or using nut and bolt combinations. According to yet another method of attaching the flange 20 to the web 50, the entire I-beam 10 is integrally constructed to eliminate all seams and the need to use fasteners 106 to attach the flanges 20,60 to the web 100.

The curved segment 40 of the first flange 20 has an outer surface 42 and an inner surface 44. The outer surface 42 is the point of contact for the wall panel or other structural element attached to the I-beam 10, as explained above, and is preferably serrated, as depicted in FIG. 1. Serrations on the outer surface 42 grip the structural element attached to the flange 20 and prevent it from shifting or otherwise moving. Such serrations are especially advantageous as a planar structural element has minimal contact with the outer surface 42, as depicted in FIG. 4, which minimizes the number of fasteners that may be used to secure the wall panel to the flange 20. While the outer surface 42 has been described as having serrations, the outer surface 42 may include small bumps or otherwise be coarse to grip a structural element that is attached thereto. Alternatively, the outer surface may not be coarse at all but may be substantially smooth.

Figure 6:
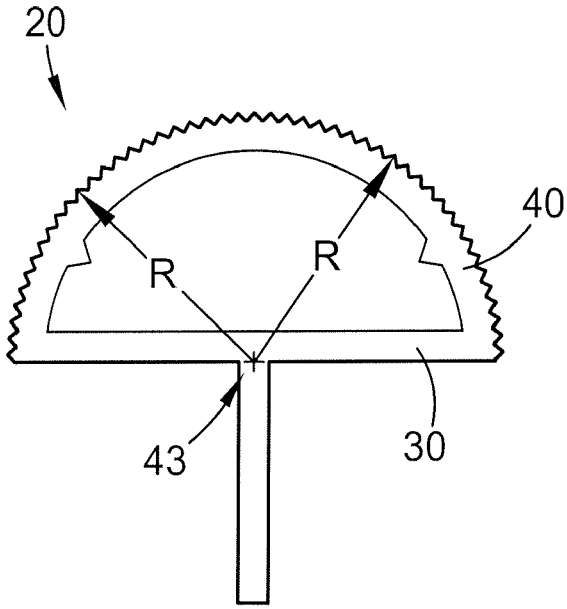
FIG. 6 is a vertical cross-sectional view of a flange of the I-beam of FIG. 1 illustrating an outer surface with a uniform radius of curvature.

Referring also to FIG. 6, the outer surface 42 preferably presents a uniform radius of curvature R with a center of the curve 43 near a center of the planar segment 30. A uniform radius of curvature maximizes structural integrity by eliminating substantially planar, unsupported portions of the curved segment 40 which would be more susceptible to bending or other deformation. A uniform radius of curvature also ensures ease of attachment at any point along the outer surface 42 by eliminating portions of the curved segment 40 with very small radii of curvature. While the outer surface 42 of the present invention has been described as having a uniform radius of curvature, it will be appreciated that the radius of curvature may be non-uniform to meet particular needs.

The inner surface 44 of the curved segment 40 may include ridges 46 that further strengthen the flange 20. In the preferred embodiment, inner surface 44 includes two ridges 46 that are substantially triangle-shaped and extend approximately one-eighth of an inch from the inner surface 44. While in the preferred embodiment each of the ridges 46 is located approximately one-half of an inch from the corner of the peripheral wall, the ridges 46 may be of any size and shape and may be located anywhere on an inner surface of the wall or an outer surface of the wall. Furthermore, there may be any number of ridges 46 on the flange 20.

In the preferred embodiment the planar segment 30 is one-eighth inch thick and two inches wide, and the curved segment 40 is also one-eighth inch thick and presents a one-inch radius of curvature. The dimensions may be adjusted to meet the needs of a particular use of the I-beam 10. It may be necessary, for example, to increase the thickness of the planar segment 30 and/or the curved segment 40 in order to maintain structural integrity under particularly heavy loads. It may also be necessary to adjust the size and/or shape of the flange 20 to accommodate the design demands of a particular implementation of the I-beam 10.

The planar segment 30 and the curved segment 40 of the flange 20 combine to form the peripheral wall mentioned above. It will be appreciated that the peripheral wall may prevent the damage resulting from excess condensation dripping from fasteners by enclosing the fasteners and thus preventing the accumulation of condensation or channeling the flow of excess condensation. As explained above in the section entitled "DESCRIPTION OF PRIOR ART," traditional I-beams with planar flanges may allow condensation to accumulate on fasteners until it begins to drip, which can cause corrosion or other damage to a structure if not contained. The present invention encloses the end of a fastener within the D-shaped flange, as illustrated in FIG. 4. Thus, moisture may be prevented from accumulating on the fastener by, for example, filling the flange 20 with insulation or other filler. Furthermore, if the flange 20 is left open and moisture accumulates on the fastener, any moisture that drips will be channeled and/or captured inside the flange 20, thus preventing the splashing and scattering of moisture that results from drops of moisture failing uncontained several feet or more. It would be desirable in the latter scenario to construct the flange of stainless steal, aluminum, or other material substantially resistant to water corrosion.

The second flange 60 is similar in structure and function to the first flange 20, and is located on the I-beam 10 opposite the first flange 20 so that the flanges 20,60 are substantially parallel along a longitudinal direction. The lips 50,90 of the flanges 20,60 point toward a center of the I-beam 10 and the curved segments 40,80 protrude away from the center of the I-beam 10, as illustrated in FIG. 2. While described as being similar to the first flange 20 the second flange 60 may be different than the first flange 20 in size or shape to accommodate, for example, a particular building design.

The web 100 is preferably planar and rectangular in shape, and includes a first longitudinal edge 102 and a second longitudinal edge 104. The web 100 connects the first flange 20 to the second flange 60, and must be strong enough to support a wall panel or other structural element. The web 100 is preferably made of steel or other strong metal, is one quarter of an inch thick, and eleven inches wide but may deviate widely from this shape and/or size, as explained below.

In the preferred embodiment, the first edge 102 of the web 100 abuts against the planar segment 30 of the flange 20 so that the web 100 overlaps, and is in contact with, the lip 50 of the flange 20. The lip 50 may then be attached to the web 100 with a rivet, weld or other fastener or method as explained above. Similarly, the second edge 104 abuts against the planar segment 70 of the second flange 60 so that the web 100 overlaps and attaches to the lip 90. It will be appreciated that the edges 102,104 of the web 100 need not abut against the planar segments 30,70 of the flanges 20,60 as described above, but may be separated therefrom by a space. Furthermore, the flanges 20,60 may have more than one lip each so that, for example, there is a lip on each side of the edges 102,104 of the web 100 to provide a more secure attachment.

Figure 7:
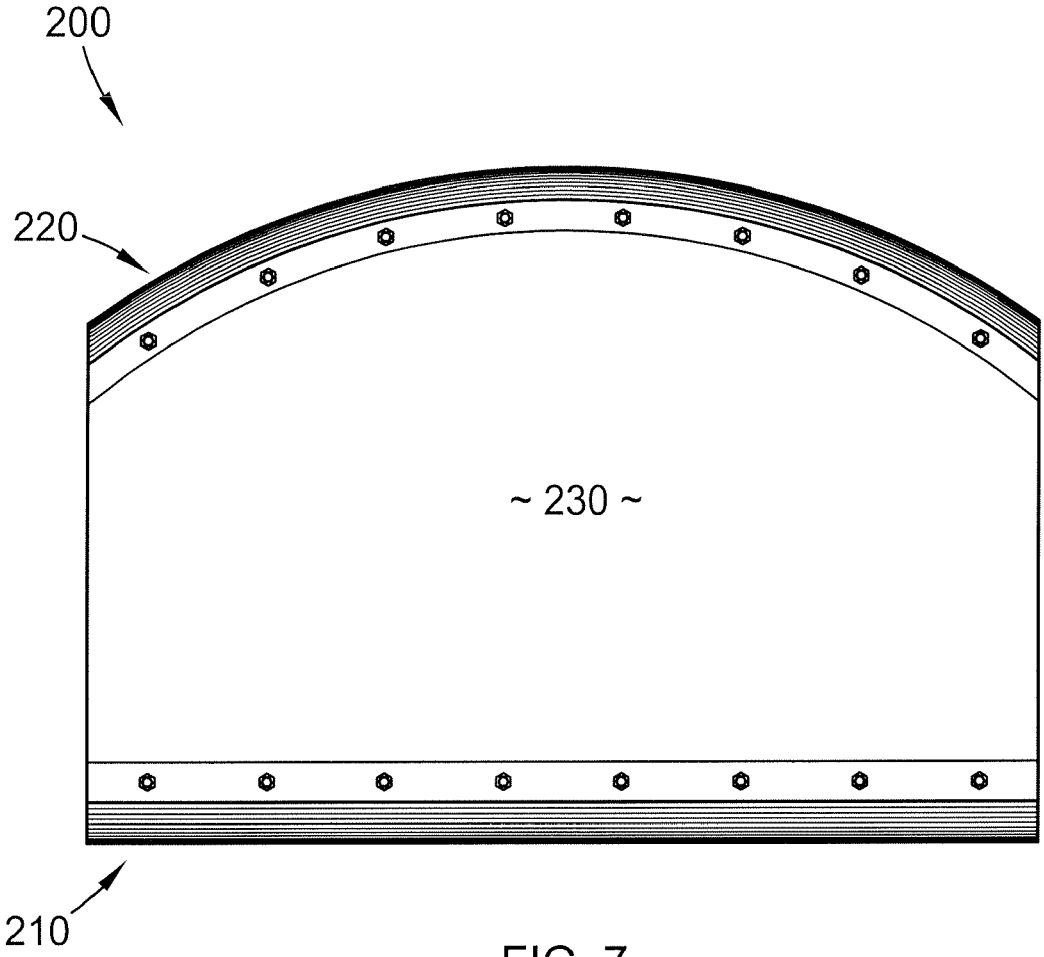
FIG. 7 is a side view of the I-beam of FIG. 1 wherein the beam includes a top flange curved along a longitudinal axis.
Figure 8:
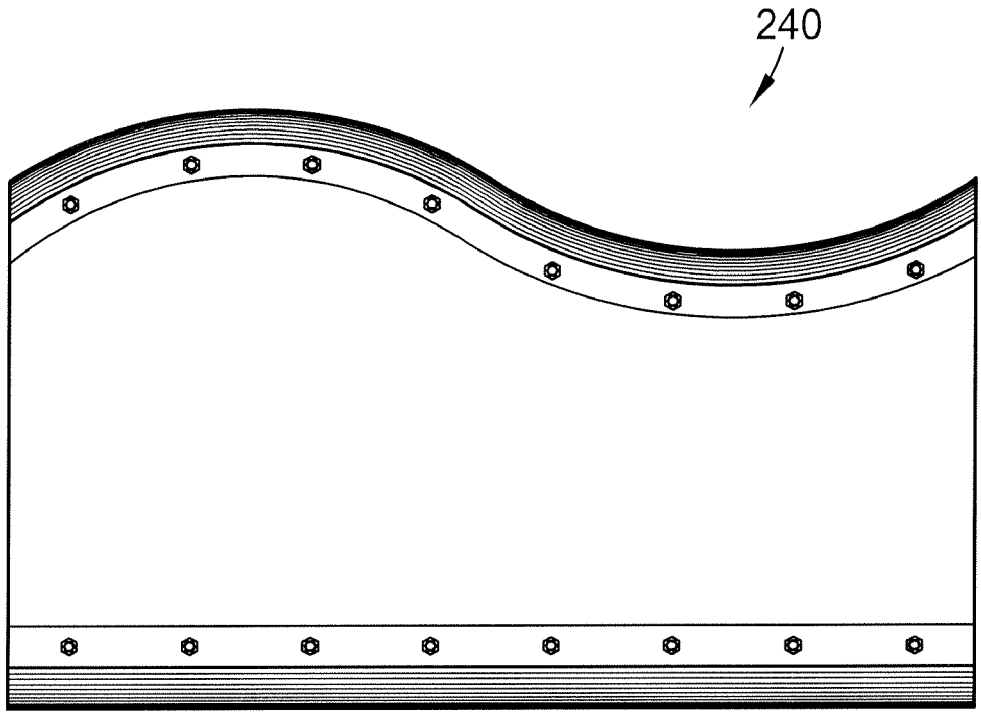
FIG. 8 is a side view of the I-beam of FIG. 1 wherein the beam includes an S-shaped top flange curved along a longitudinal axis.
Figure 9:
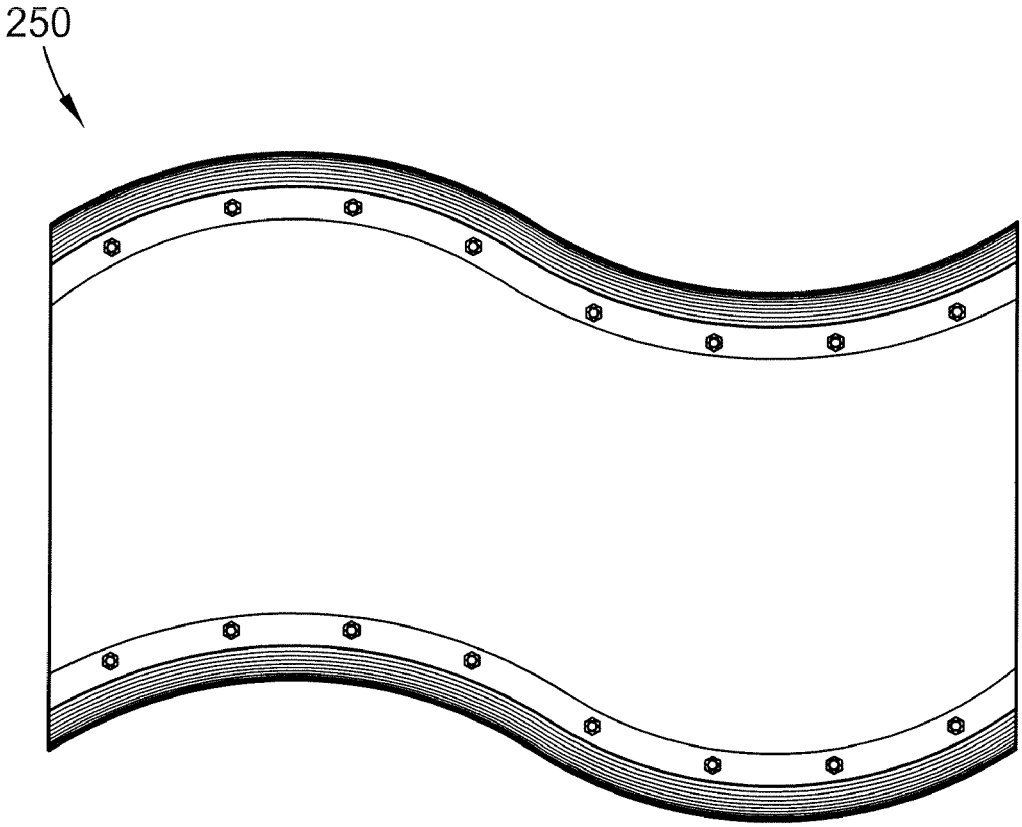
FIG. 9 is a side view of the I-beam of FIG. 1 wherein the beam includes S-shaped top and bottom flanges curved along a longitudinal axis.
Figure 10:
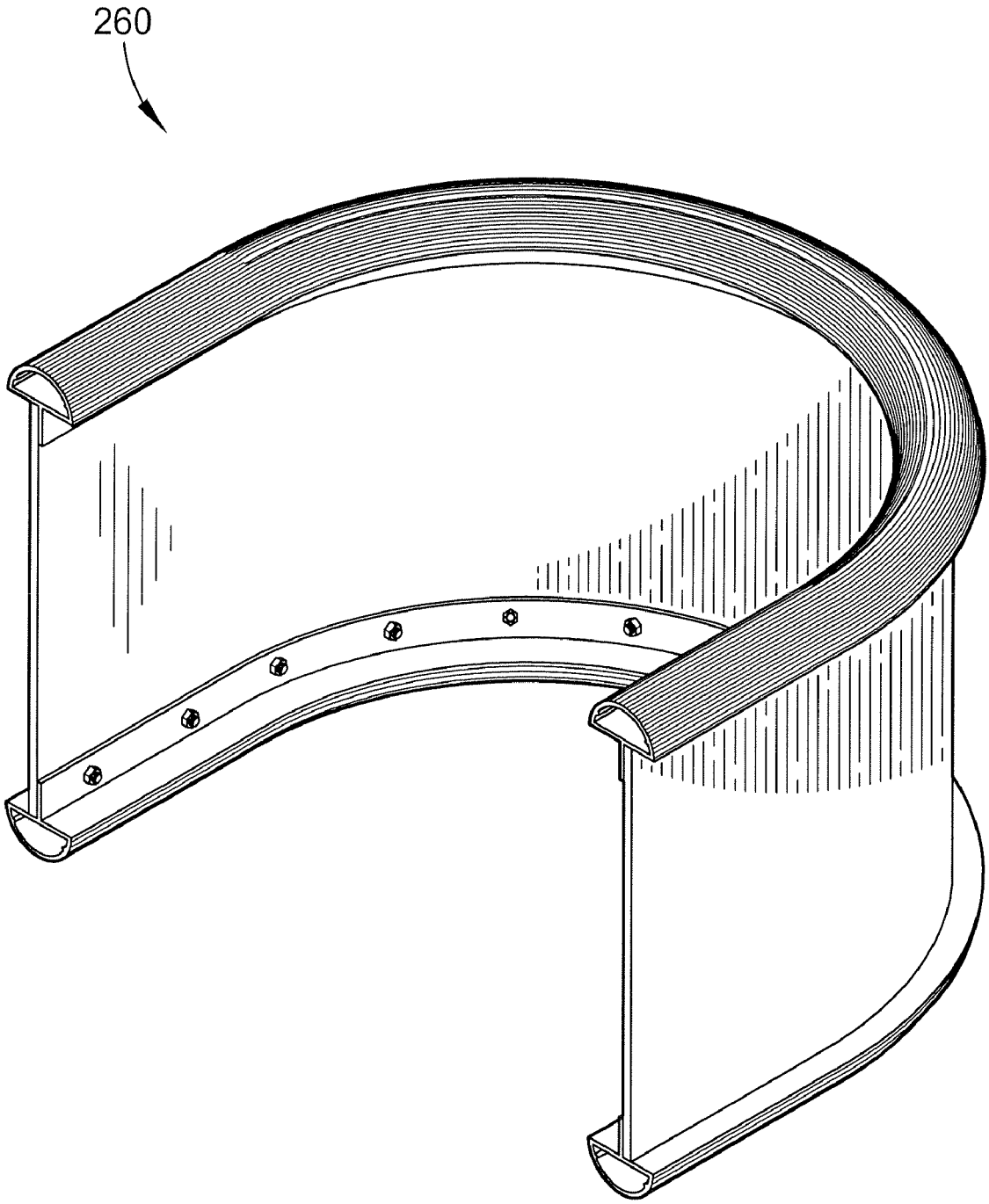
FIG. 10 is a top view of the I-beam of FIG. 1 wherein the beam is bowed along a longitudinal axis.

The web 100 has been shown and described as being substantially rectangular and planar, and the flanges 20,60 have been shown and described as being substantially straight and parallel. It will be appreciated that the present invention lends itself to variations of this configuration, particularly where an I-beam is desired that is curved along a longitudinal axis. FIG. 7 illustrates an I-beam 200 with a straight bottom flange 210 and a curved top flange 220 connected by a web 230 with a straight bottom edge and a curved top edge. FIG. 8 illustrates an I-beam 240 similar to the I-beam 200, except that the top flange of the I-beam 240 is substantially S-shaped. Thus, I-beams 200,240 present webs of varying thickness. FIG. 9 illustrates an I-beam 250 that has substantially S-shaped top and bottom flanges connected by a substantially S-shaped web. FIG. 10 illustrates an I-beam 260 with a web of uniform width wherein the I-beam is bowed about a vertical lateral axis. While the I-beam 260 is shown and described as being bowed about a single lateral axis, it will be appreciated that the I-beam 260 may be bowed about two or more lateral axes to form, for example, an S-shaped bowed I-beam. Furthermore, an I-beam within the scope of the present invention may present any combination of curves or bows described herein.

It may be desirable to vary the shape and thickness of the I-beam for aesthetic reasons, to match the shape of a structure or surface, or to accommodate a particular stress load. The I-beam 200 may be useful, for example, where the stress on the center of the I-beam 200 is great and requires a wider web to support it, while toward the ends of the I-beam 200 the stress is less and the web is narrower. This makes the I-beam 200 less costly to manufacture and easier to transport and/or install without compromising the structural integrity of the I-beam 200.

The flanges 210,220 may be removably attachable to the web 230 as explained above. Thus manufacturing I-beams of different sizes and shapes is facilitated as the flanges 210,220 may be manufactured independently of the web 100. Also, different flanges may be combined with different webs to form a desired I-beam. For example, if an I-beam similar to the I-beam 200 is desired but with a narrower web, the flanges 210,220 may be used with a narrower web to form the desired I-beam.

Although the invention has been described with reference to the preferred embodiments illustrated in the attached drawings, it is noted that equivalents may be employed and substitutions made herein without departing from the scope of the invention as recited in the claims. It will be appreciated, for example, that the peripheral walls of the flanges 20,60 may be of any thickness, or may be of varying thickness. Furthermore, the flanges 20,60 may not have peripheral walls but may be solid.

Having thus described the preferred embodiment of the invention, what is claimed as new and desired to be protected by Letters Patent includes the following:

1. An I-beam comprising:

a first flange to strengthen the I-beam, the first flange including— a peripheral wall one-eighth inch thick with a first segment and a curved segment presenting a D-shaped cross section, wherein the first segment is two inches wide and the curved segment has a uniform one inch radius of curvature and includes an inner surface and a serrated outer surface, the inner surface having two triangle-shaped ridges, each ridge extending one-eighth inch from the inner surface and located one-half inch from a corner of the wall, and a lip one-eighth inch thick and integrally attached to the first segment of the wall, extending perpendicularly one inch from an outer surface of the first segment of the wall, and extending longitudinally along the first portion of the wall, wherein the first flange is curved along a longitudinal axis;

a second flange substantially identical to the first flange, wherein the second flange is separated from the first flange by a space so that the lip of each flange extends toward a center of the beam and the curved segment of each flange is distal to the center of the beam; and a web joining the two flanges, wherein the web is sixteen inches wide and one-fourth inch thick with a first longitudinal edge and a second longitudinal edge, the first edge is fixedly attached to the lip of the first flange, and the second edge is fixedly attached to the lip of the second flange.

2. The beam as set forth in claim 1, wherein the first longitudinal edge of the web is curved along a longitudinal axis.

3. The beam as set forth in claim 1, wherein both longitudinal edges of the web and both D-shaped flanges are curved along a longitudinal axis.

4. The beam as set forth in claim 1, wherein the beam is bowed about a lateral axis.

* * * * *